US009309850B2

(12) United States Patent
Akazaki et al.

(10) Patent No.: US 9,309,850 B2
(45) Date of Patent: Apr. 12, 2016

(54) FUEL INJECTION VALVE

(71) Applicants: Hitachi Automotive Systems, Ltd., Hitachinaka-shi, Ibaraki (JP); Honda Motor Co., Ltd., Minato-ku, Tokyo (JP)

(72) Inventors: Shusuke Akazaki, Wako (JP); Atsushi Takaoku, Hitachinaka (JP); Masahiro Soma, Hitachinaka (JP)

(73) Assignees: Hitachi Automotive Systems, Ltd., Hitachinaka-shi (JP); Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 14/406,064

(22) PCT Filed: Jun. 7, 2013

(86) PCT No.: PCT/JP2013/065837

§ 371 (c)(1),
(2) Date: Dec. 5, 2014

(87) PCT Pub. No.: WO2013/183762

PCT Pub. Date: Dec. 12, 2013

(65) Prior Publication Data

US 2015/0115069 A1 Apr. 30, 2015

(30) Foreign Application Priority Data

Jun. 8, 2012 (JP) ..... 2012-130923

(51) Int. Cl.

| | |
|---|---|
| ***F02M 51/00*** | (2006.01) |
| ***F02M 61/14*** | (2006.01) |
| ***F02M 61/16*** | (2006.01) |

(Continued)

(52) U.S. Cl.
CPC ..... *F02M 61/14* (2013.01); *F02M 51/005* (2013.01); *F02M 61/04* (2013.01); *F02M 61/168* (2013.01); *F02M 57/005* (2013.01);
(Continued)

(58) Field of Classification Search
CPC ..... F02M 51/005; F02M 51/06; F02M 61/12; F02M 61/14; F02M 61/168; F02M 61/18
See application file for complete search history.

(56) References Cited

U.S. PATENT DOCUMENTS 5,009,390 A * 4/1991 McAuliffe et al. ..... 251/129.2
5,794,856 A * 8/1998 Nally ..... 239/408

(Continued)

FOREIGN PATENT DOCUMENTS

JP 3-70863 A 3/1991
JP 8-319919 A 12/1996

(Continued)

OTHER PUBLICATIONS

International Search Report (PCT/ISA/210) dated Aug. 27, 2013 with English translation (five pages).

(Continued)

*Primary Examiner* — Ryan Reis
(74) *Attorney, Agent, or Firm* — Crowell & Moring LLP

(57) ABSTRACT

A fuel injection valve that injects fuel directly into a cylinder of an internal combustion engine includes: a nozzle inserted into a fuel injection valve fitting hole formed in the cylinder; a cylindrical tip seal holder attached to the nozzle; and an annular seal member that is fitted to the tip seal holder and seals between an inner circumferential surface of the fuel injection valve fitting hole and an outer circumferential surface of the tip seal holder.

7 Claims, 12 Drawing Sheets

(51) Int. Cl.
*F02M 61/04* (2006.01)
*F02M 57/00* (2006.01)

(52) U.S. Cl.
CPC . *F02M 2200/247* (2013.01); *F02M 2200/8084* (2013.01); *F02M 2200/858* (2013.01)

(56) References Cited

U.S. PATENT DOCUMENTS

| | | | | |
|---|---|---|---|---|
| 6,598,809 | B1 * | 7/2003 | Reiter et al. | 239/408 |
| 7,104,477 | B2 * | 9/2006 | Kilgore et al. | 239/585.1 |
| 2008/0296414 | A1 | 12/2008 | Kubota et al. | |
| 2010/0050991 | A1 * | 3/2010 | Cooke | 123/470 |

FOREIGN PATENT DOCUMENTS

| | | | |
|---|---|---|---|
| JP | 2001-41096 | A | 2/2001 |
| JP | 2001-504912 | A | 4/2001 |
| JP | 4491474 | B2 | 6/2010 |
| JP | 2010-174764 | A | 8/2010 |
| JP | 2011-64124 | A | 3/2011 |
| JP | 2011-220259 | A | 11/2011 |
| WO | WO 2008/114534 | A1 | 9/2008 |

OTHER PUBLICATIONS

Japanese Office Action issued in counterpart Japanese Application No. 2014-520068 dated Jan. 19, 2016, with English translation (eight (8) pages).

* cited by examiner (a)

(b)

(a)

(b)

(a)

(b)

(a)

(b)

FUEL INJECTION VALVE

TECHNICAL FIELD

The present invention relates to a fuel injection valve that is used in an internal combustion engine.

BACKGROUND ART

A fuel injection valve of the cylinder injection type that supplies fuel directly into a combustion chamber of an internal combustion engine is per se known (refer to Patent Document #1). When such a fuel injection valve is attached to its cylinder, an annular seal member is sandwiched between the inner circumferential surface of the fuel injection valve fitting hole and the outer circumferential surface of the nozzle that is inserted into the fuel injection valve fitting hole, and thereby leakage of combustion gases is prevented.

CITATION LIST

Patent Literature

Patent Document #1: Japanese Laid-Open Patent Publication 2011-64124.

SUMMARY OF INVENTION

Technical Problem

With the fuel injection valve described in Patent Document #1, a groove for fitting the seal member is provided in the outer circumferential surface of the nozzle, and the shape of the nozzle is determined to match the diameter of the fuel injection valve fitting hole in the cylinder. Due to this, with the fuel injection valve described in Patent Document #1, it is necessary to make nozzles for each cylinder type that has a different fuel injection valve fitting hole diameter.

Solution to Technical Problem

A fuel injection valve, according to a first aspect of the present invention, that injects fuel directly into a cylinder of an internal combustion engine, comprises: a nozzle inserted into a fuel injection valve fitting hole formed in the cylinder, a cylindrical tip seal holder attached to the nozzle; and an annular seal member that is fitted to the tip seal holder and seals between an inner circumferential surface of the fuel injection valve fitting hole and an outer circumferential surface of the tip seal holder.

Advantageous Effects of Invention

Since, according to the present invention, it is sufficient to manufacture a tip seal holder according to the diameter of the fuel injection valve fitting hole, and thereby it is possible to fit nozzles of the same shape to fuel injection valve fitting holes of a plurality of types having different diameters, accordingly it is possible to anticipate an enhancement of productivity.

DESCRIPTION OF EMBODIMENTS

Embodiments of a fuel injection valve according to the present invention will now be explained in the following with reference to the drawings.

—The First Embodiment—

Figure 1:
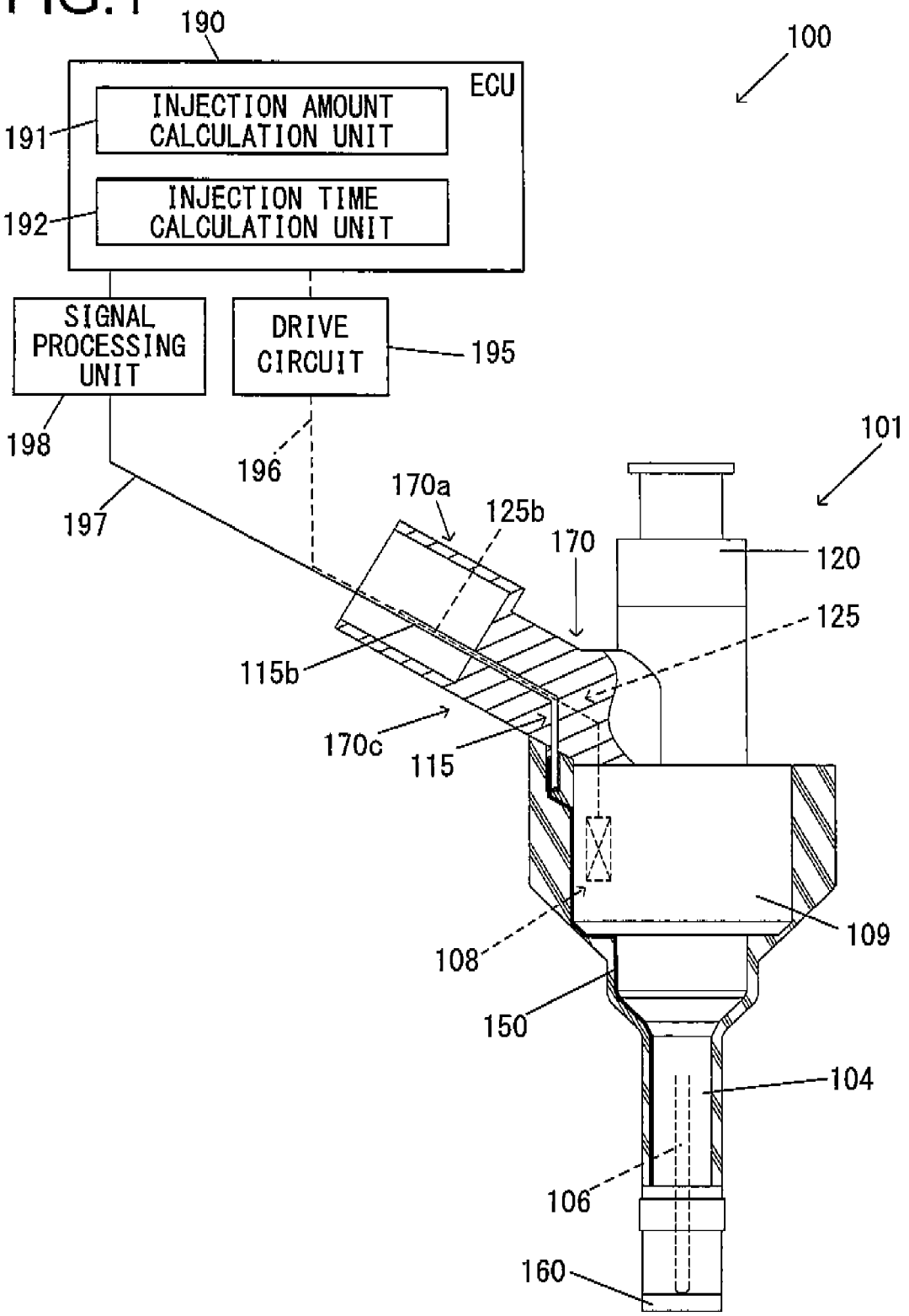
FIG. 1 is a block diagram showing the structure of a fuel injection device.

FIG. 1 is a block diagram showing the structure of a fuel injection device 100 that comprises a fuel injection valve 101 according to a first embodiment of the present invention. The fuel injection device 100 comprises a ECU 190 that is a fuel injection control device, and the fuel injection device 101.

The ECU 190 takes in information for an internal combustion engine as detected by sensors of various types, such as its rotational speed, its boost pressure, its intake air amount, its intake temperature, its water temperature, its fuel pressure, and so on, and performs optimum control of fuel injection adapted to the state of the internal combustion engine (engine).

The ECU 190 comprises an injection amount calculation unit 191 that calculates an optimum injection amount on the basis of the information that has been read in, and an injection time calculation unit 192 that calculates an injection time period on the basis of the result calculated by the injection amount calculation unit 191.

Information about the injection pulse width calculated by the injection time calculation unit 192 is transmitted to a drive circuit 195. This drive circuit 195 generates a drive current that corresponds to the injection pulse width and supplies this drive current to an electromagnetic coil 108 that is disposed around the external periphery of a movable valve body 106 of the fuel injection valve 101, thereby pulling upon the movable valve body 106 with magnetic attraction to open the valve, and then holds the valve in the open state over a time interval corresponding to the injection pulse width, thereafter closing the valve. In other words, the opening and closing operation of the fuel injection valve 101 is performed by the electromagnetic force of the electromagnetic coil 108.

In this embodiment, a pressure sensor 160 that detects the pressure within the cylinder is provided at the end of the fuel injection valve 101. The signal detected by the pressure sensor 160 is inputted to the ECU 190 via a signal processing unit 198. This signal processing unit 190 performs analog to digital processing upon the signal detected by the pressure sensor 160.

Figure 2:
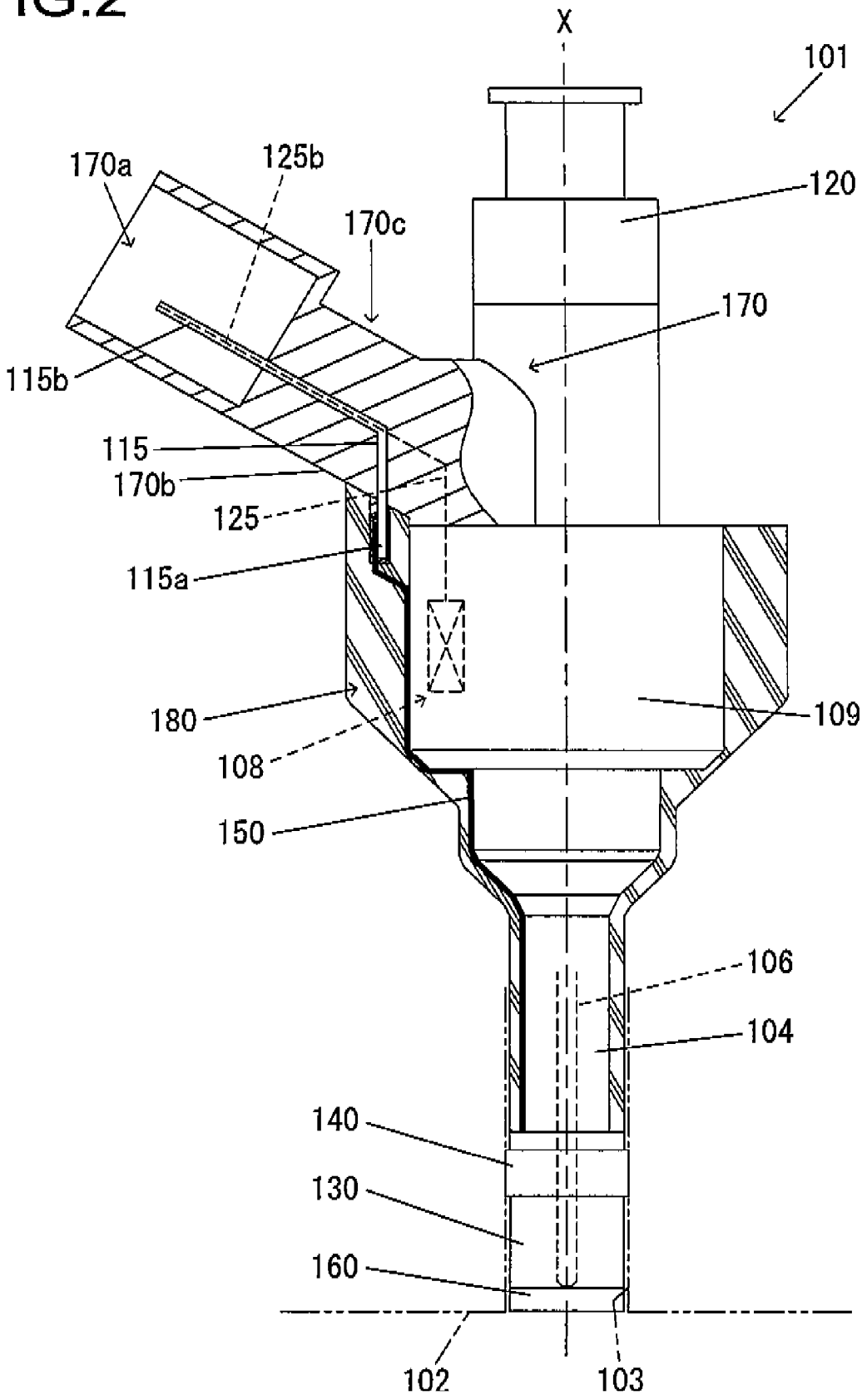
FIG. 2 is a partially cutaway schematic side view showing a fuel injection valve according to a first embodiment of the present invention.
Figure 3:
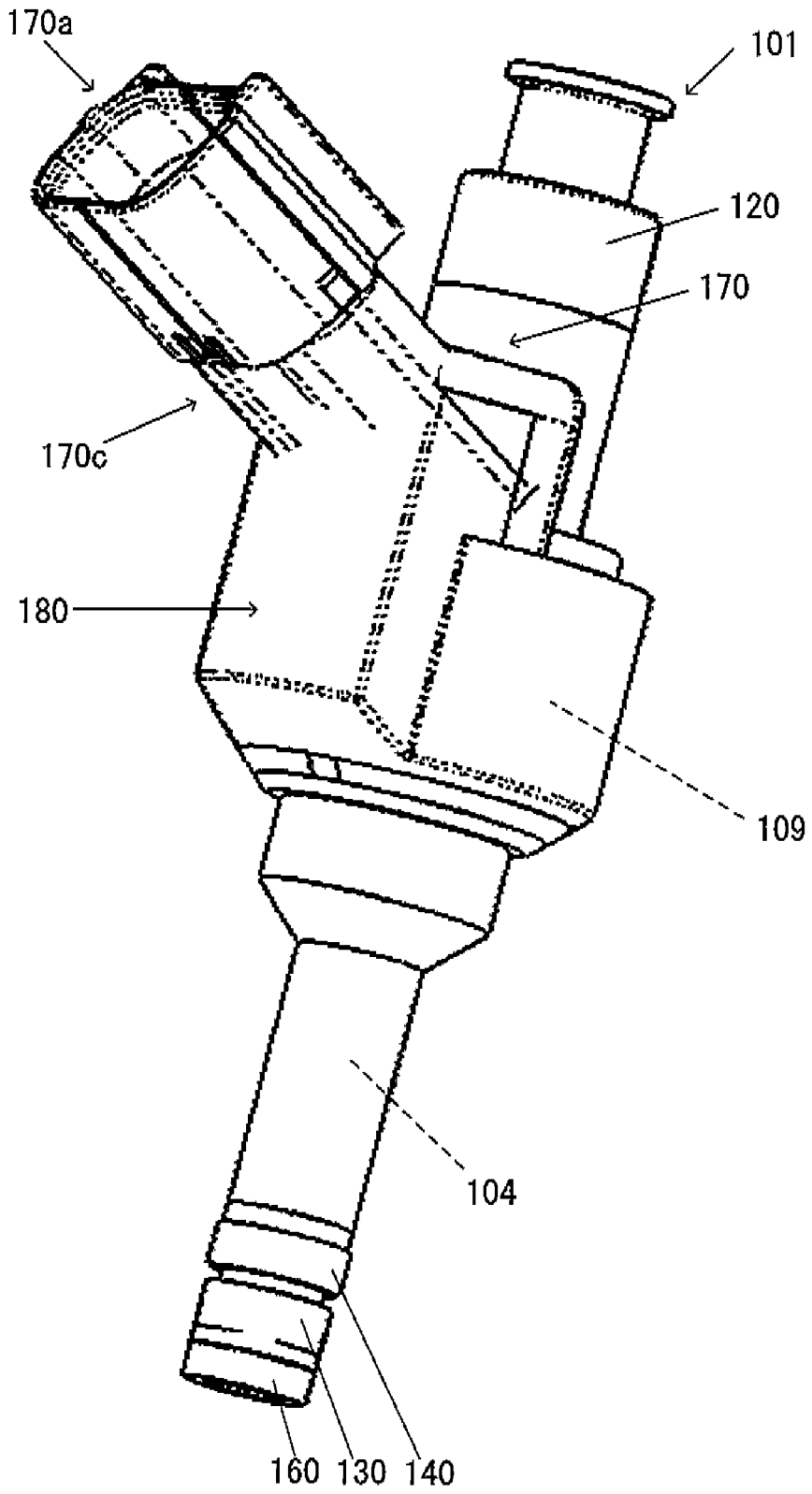
FIG. 3 is an external perspective view showing this fuel injection valve according to the first embodiment of the present invention.

The structure of the fuel injection valve 101 will now be explained with reference to FIG. 2 and FIG. 3. FIG. 2 is a partially cutaway schematic side view showing the fuel injection valve 101, and FIG. 3 is an external perspective view showing the fuel injection valve 101. This fuel injection valve 101 is an electromagnetically driven type fuel injection valve that injects fuel such as gasoline or the like directly into a cylinder of an internal combustion engine. The fuel injection valve 101 comprises a housing (also termed a "yoke") 109 and a nozzle 104 that is fixed to the housing 109 by being pressed into a portion thereof. The lower portion in the figure of an elongated hollow tubular core 120 is inserted into the housing 109, and the interior of this core 120 is employed as a fuel passage. The electromagnetic coil 108 is disposed around the outside of this core 120, and is received within the housing 109.

As shown in FIG. 2, the movable valve body 106 is disposed within the nozzle 104 upon the central axis of the fuel injection valve 101 (hereinafter also simply termed the "central axis X"). When an excitation current is supplied to the electromagnetic coil 108, the movable valve body 106 is shifted upward in the figure along the central axis X by magnetic force, so that the fuel injection valve is opened.

A molded connector body 170 (i.e. a resin molding) is formed by a per se known injection molding method at the external periphery of the portion of the core 120 that projects from the housing 109. A portion of this molded connector body 170 is made as an elongated portion 170*c* that juts out slantingly upward in the figure from the housing 109, and the end portion of this elongated portion is formed as a connector portion 170*a*.

The molded connector body 170 holds a pair of external excitation terminals 125 and an external sensor terminal 115 in an insulated state. One end of each of the external excitation terminals 125 is formed as an excitation connection terminal 125*b*, and is positioned in the connector portion 170*a* (refer to FIG. 2 and FIG. 6). As shown in FIG. 1, wiring 196 for supplying excitation current to the electromagnetic coil 108 is connected to the excitation connection terminals 125, and wiring 197 for taking out the detection signal detected by the pressure sensor 160 is connected to a sensor connection terminal 115*b*.

As shown in FIG. 1, the pressure sensor 160 that detects the pressure within the cylinder is fitted to the end or tip of the nozzle 104, and a signal line 150 is connected to the pressure sensor 160. Except for its electrical connection portions, the conducting wire of the signal line 150 is covered with a covering material, and one end of this conducting wire is connected to the pressure sensor 160, while its other end is connected to the external sensor terminal 115. The detection signal detected by the pressure sensor 160 is supplied to the ECU 190 via the signal line 150 and the external sensor terminal 115, and via the wiring 197. The signal line 150 is arranged so as to pass through the outer circumferential surface portions of the housing 109 and the nozzle 104 (refer to FIG. 2 and FIG. 5). After this signal line 150 has been adhered to the outer circumferential surfaces of the housing 109 and the nozzle 104 with adhesive or the like, it is covered over along with the housing 109 and the nozzle 104 with a secondary molded body 180 (refer to FIG. 2 and FIG. 3).

Figure 4:
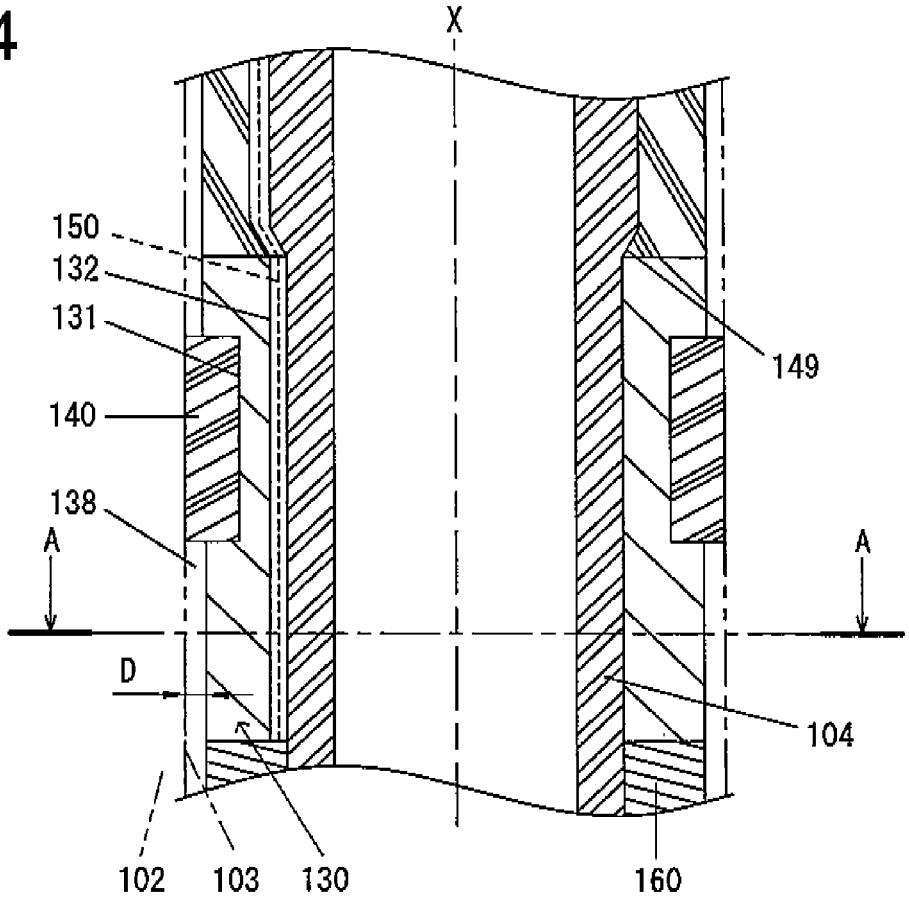
FIG. 4(*a*) is a schematic cross sectional view showing the vicinity of the end of a nozzle, while FIG. 4(*b*) is a sectional view thereof taken perpendicular to lines A-A in FIG. 4(*a*)
Figure 4:
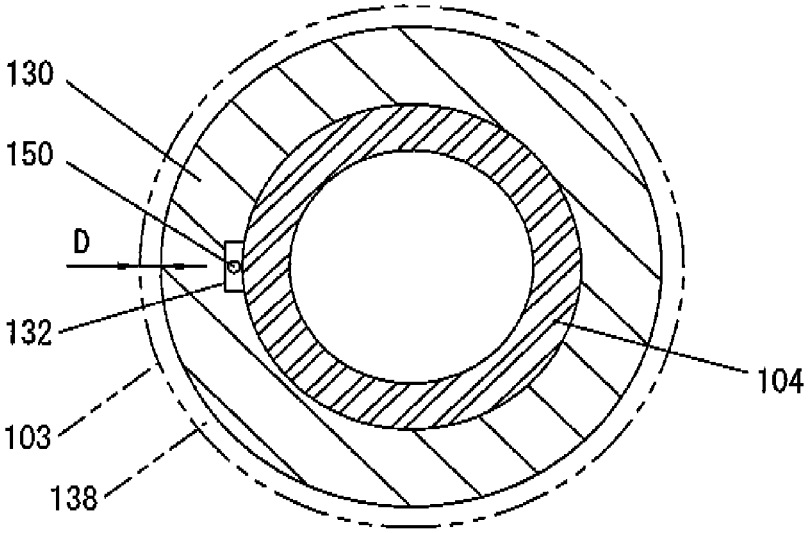

As shown in FIG. 2 and FIG. 3, a tip seal holder 130 is disposed in the neighborhood of the end of the nozzle 104, with a tip seal 140 being fitted on this tip seal holder 130. This tip seal holder 130 fitted to the nozzle 104 will now be explained with reference to FIG. 4. FIG. 4(*a*) is a schematic cross sectional view showing the vicinity of the end of the nozzle 104, while FIG. 4(*b*) is a sectional view thereof taken by the line A-A in FIG. 4(*a*).

The tip seal holder 130 is a cylindrical member, and its central axis coincides with the central axis X of the fuel injection valve 101. A groove 131 is provided upon the outer circumferential surface of the tip seal holder 130, and extends around its circumferential direction. The tip seal 140, that is an annular seal member, is set into the groove 131, as shown in FIG. 4(*a*)

The tip seal holder 130 is press fitted over the nozzle 104 from its end, and is laser welded in a predetermined position. In this embodiment, the diameter of the nozzle 104 is increased at a position that is separated by a predetermined distance from the end of the nozzle 104, so that a difference in level or a step 149 is provided at this point. One end of the tip seal holder 130 is engaged against this difference in level 149. This difference in level 149 is provided in order to determine the position of the tip seal holder 130. When the tip seal holder 130 is being fitted, its position can be determined simply and easily by pressing it on until one end of the tip seal holder 130 engages to this difference in level 149.

As shown in FIG. 2 and FIG. 4, a fuel injection valve fitting hole 103 is formed in a cylinder head 102. When the nozzle 104 of the fuel injection valve 101 is inserted in this fuel injection valve fitting hole 103, the tip seal 140 provides a seal between the inner circumferential surface of the injection valve fitting hole 103 and the outer circumferential surface of the tip seal holder 130.

As shown in FIG. 4, the dimension D of the clearance 138 between the outer circumferential surface of the tip seal holder 130 at the pressure sensor 160 side and the inner circumferential surface of the fuel injection valve fitting hole 103 is set to around 0.2 mm. By setting this dimension D of the clearance 138 to less than or equal to a predetermined dimension, it is possible to prevent destruction of the tip seal 140 originating due to direct contact of combustion gases at high temperature against the tip seal 140.

An insertion groove 132 is formed upon the inner circumferential surface of the tip seal holder 130, and extends along the central axis X. The signal line 150 of the pressure sensor 160 is inserted into a space defined by this insertion groove 132 and the outer circumferential surface of the nozzle 104.

The signal line 150 passes along the insertion groove 132 from the pressure sensor 160, and, as shown in FIG. 2, extends along the external circumferential surfaces of the nozzle 104 and the housing 109 towards the elongated portion 170*c* of the molded connector body 170. And this signal line 150 is electrically connected to a projecting portion 115*a* that projects towards the pressure sensor 160 from a sloping surface portion 170*b*, that is the surface of the elongated portion 170*c* facing toward the pressure sensor 160.

Figure 5:
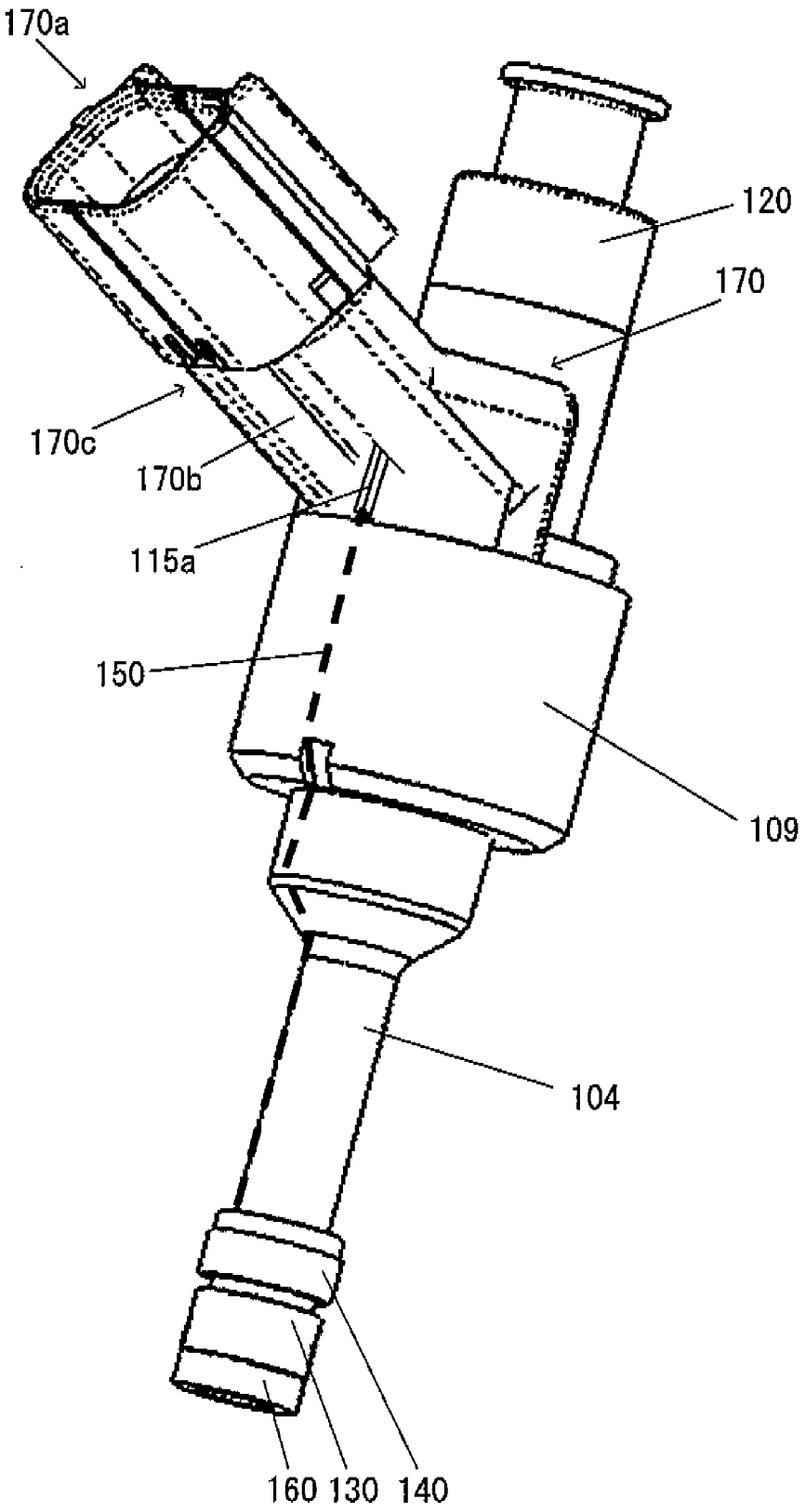
FIG. 5 is an external perspective view showing a state of the fuel injection valve before a secondary molded body thereof is formed.
Figure 6:
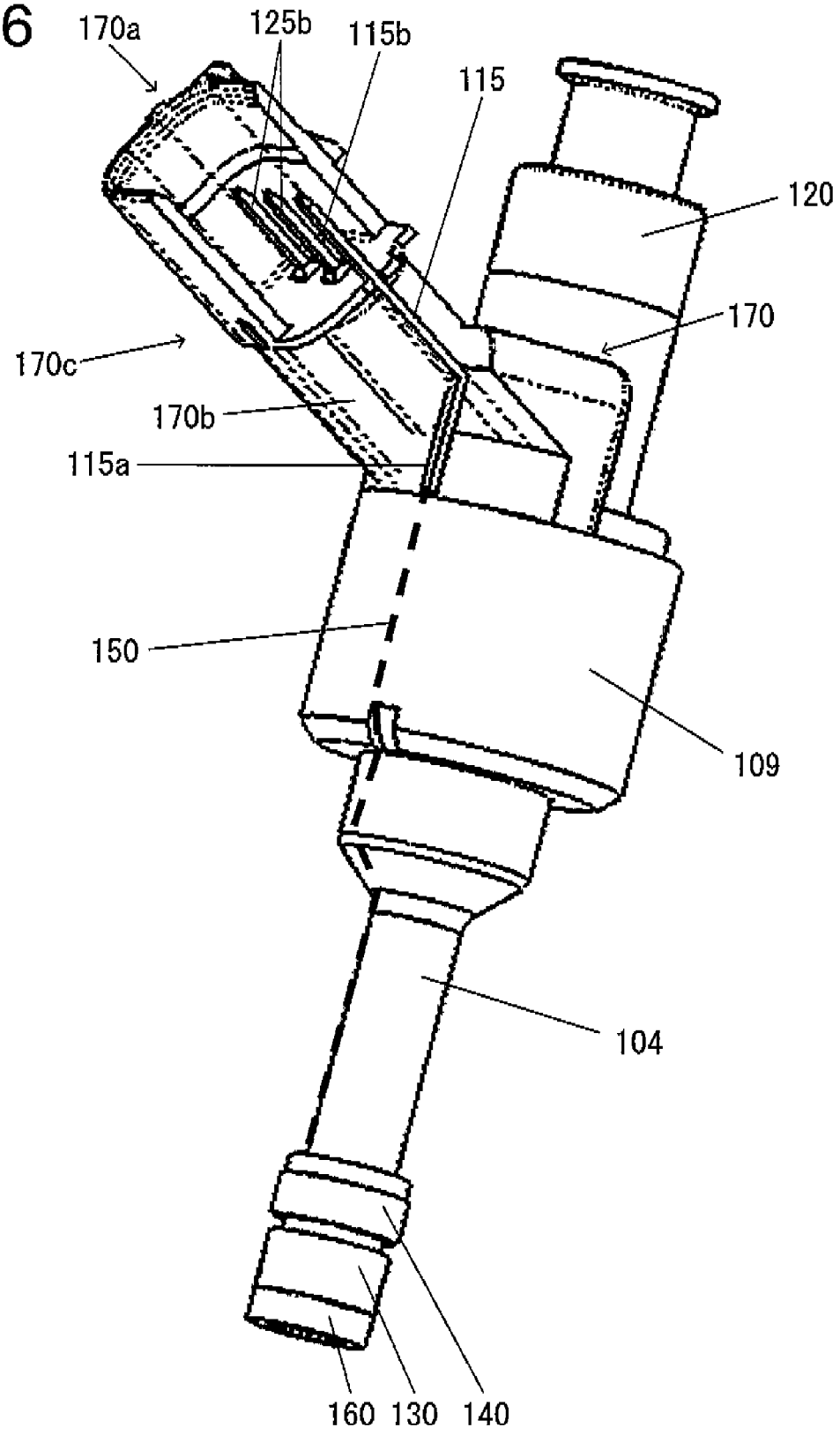
FIG. 6 is a partially cutaway perspective view showing this state of the fuel injection valve before the secondary molded body is formed.
Figure 7:
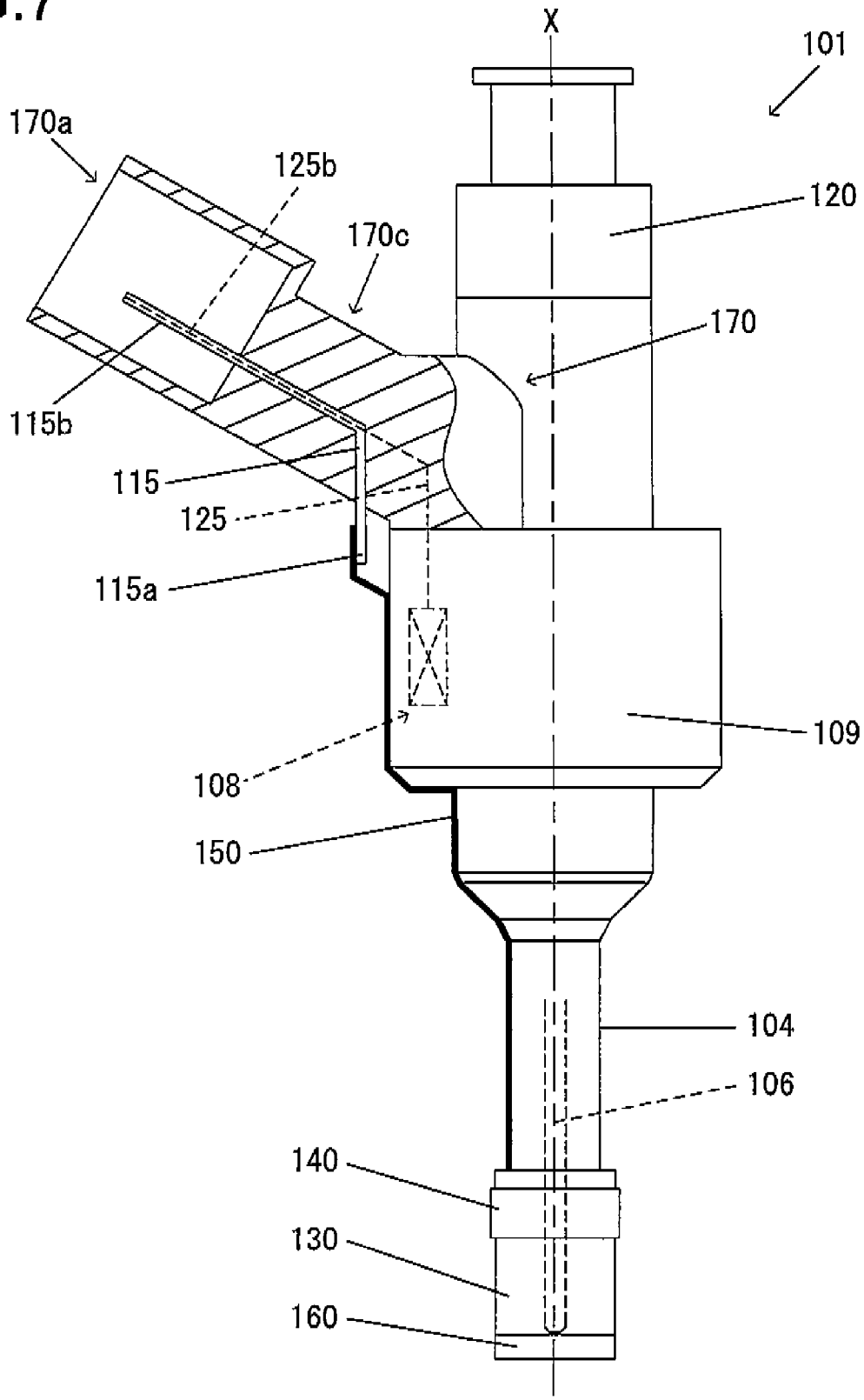
FIG. 7 is a partially cutaway schematic side view showing this state of the fuel injection valve before the secondary molded body is formed.

FIG. 5, FIG. 6, and FIG. 7 are respectively an external perspective view, a partially cutaway perspective view, and a partially cutaway schematic side view, all showing the state of the fuel injection valve before the secondary molded body 180 of the fuel injection valve 101 is formed. As shown in FIG. 7, the external excitation terminals 125 and the external sensor terminal 115 are adhered to the molded connector body 170 that is a primary molded body.

As shown in FIG. 6, at the connector portion 170*a* of the molded connector body 170, the one ends of the pair of external excitation terminals 125 described above are exposed as the excitation connection terminals 125*b*, and one end of the external sensor terminal 115 is exposed as the sensor connection terminal 115*b*. And since, as shown in the figure, the excitation connection terminals 125*b* and the sensor connection terminal 115*b* are arranged in the single connection portion 170*a*, accordingly it is possible to perform electrical connection between the electromagnetic coil 108 and the wiring 196 (refer to FIG. 1), and electrical connection between the pressure sensor 160 and the wiring 197 (refer to FIG. 1), in a simple and easy manner.

As shown in FIG. 6 and FIG. 7, the external sensor terminal 115 extends from the sensor connection terminal 115*b* along the elongated portion 170*c* of the molded connector body 170, is bent around toward the pressure sensor 160 in the neighborhood of the housing 109, and then extends parallel to the central axis X. The end portion of the external sensor terminal 115 remote from the sensor connection terminal 115*b* is formed as the projecting portion 115*a*. As shown in FIG. 5 and FIG. 7, upon the sloping surface portion 170*b* that is the side of the elongated portion 170*c* of the molded connector body 170 that faces toward the pressure sensor 160, this projecting portion 115*a* projects from the neighborhood of the housing 109 toward the pressure sensor 160.

Figure 8:
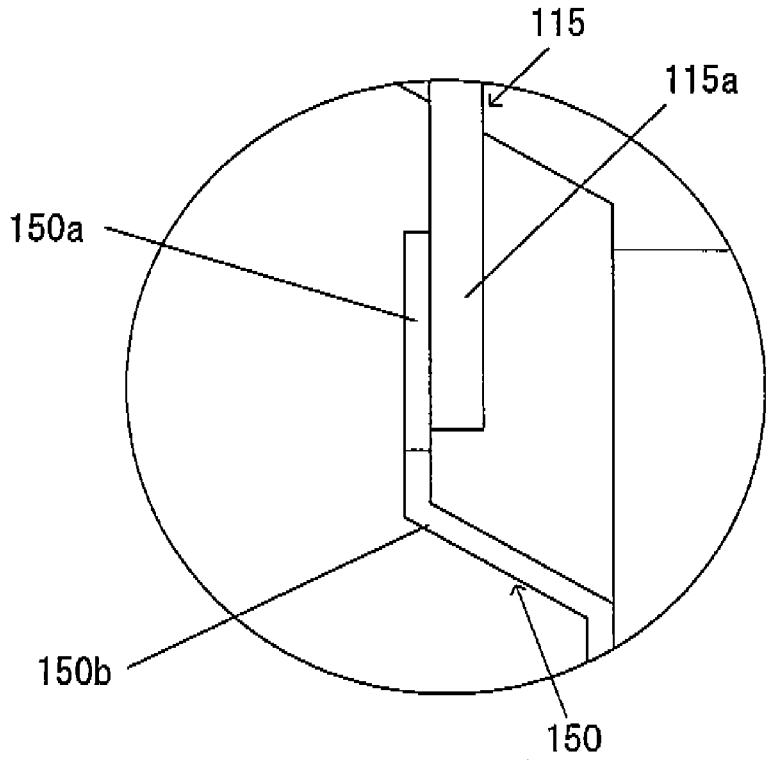
FIG. 8(*a*) is a figure for explanation of a process for position alignment of a signal line and a projecting portion, and FIG. 8(*b*) is a figure for explanation of a process for connection between the signal line and the projecting portion.
Figure 8:
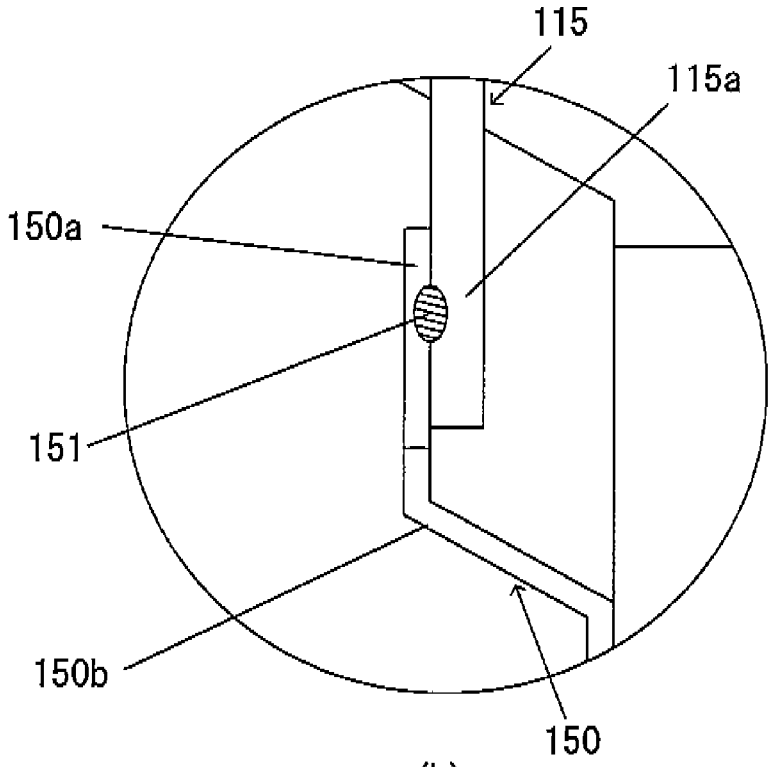
Figure 9:
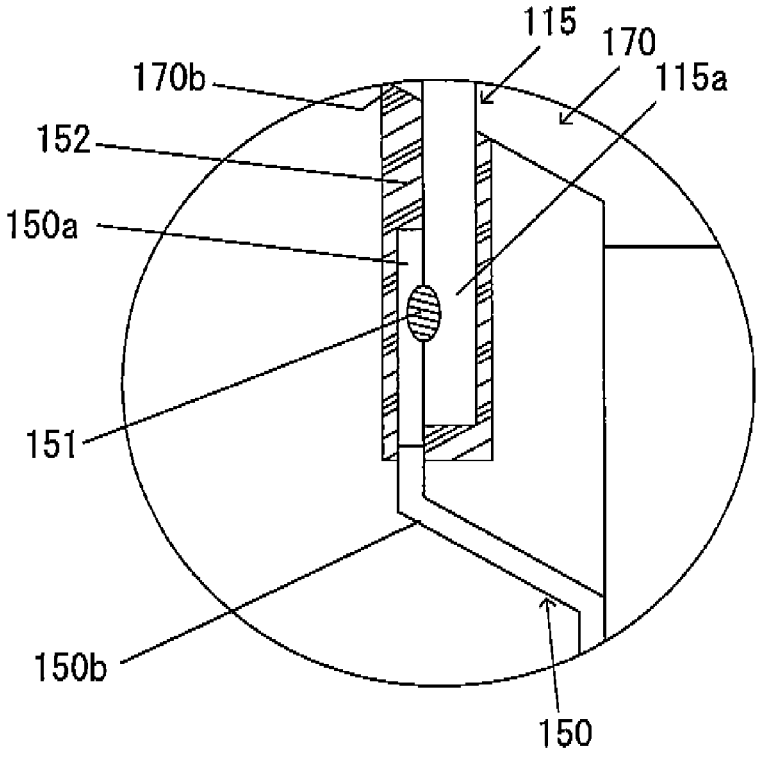
FIG. 9(*a*) is a figure for explanation of a process of adhering together the signal line and the projecting portion, and FIG. 9(*b*) is a figure for explanation of a secondary molding process.
Figure 9:
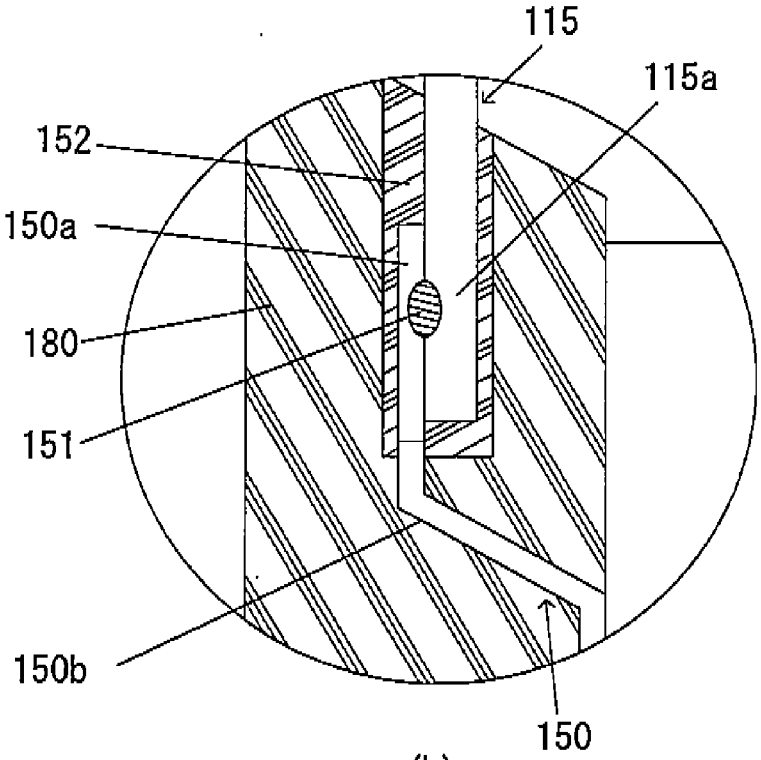

The connecting portion between the signal line 150 and the external sensor terminal 115 that is fixed in the molded connector body 170 will now be explained with reference to FIG. 8 and FIG. 9. FIG. 8(*a*) and FIG. 8(*b*) are figures for explanation of a process for aligning the positions of the signal line 150 and the projecting portion 115*a*, and for explanation of a process for connecting them together. And FIG. 9(*a*) is a figure for explanation of a process of adhering together the signal line 150 and the projecting portion 115*a*, while FIG. 9(*b*) is a figure for explanation of a secondary molding process. In FIG. 8 and FIG. 9, that are explanatory figures, the connection portion between the signal line 150 and the projecting portion 115*a* is shown as enlarged.

As shown in FIG. 8(*a*), before the signal line 150 and the projecting portion 115*a* are connected together, positional alignment of the signal line 150 and the projecting portion 115*a* is performed. It should be understood that the covering material 150*b* upon the end portion of the signal line 150 is detached in advance, as shown in FIG. 8(*a*), so that its lead wire is exposed. In the positional determination process, positional determination is performed so that an exposed portion 150*a* where no covering material 150*b* is provided is contacted against the projecting portion 115*a*.

After this positional determination, as shown in FIG. 8(*b*), the exposed portion 150*a* of the signal line 150 and the projecting portion 115*a* of the external sensor terminal 115 are electrically connected together with solder 151. After this fixing with solder, as shown in FIG. 9(*a*), silicon adhesive is applied so as to cover the entire external circumferential portions of the exposed portion 150*a* and the projecting portion 115*a*. Silicon adhesive is also applied to the sloping surface portion 170*b* of the molded connector body 170. By the silicon adhesive hardening, a layer of silicon adhesive 152 is formed around the external peripheries of the exposed portion 150*a* and the projecting portion 115*a*. This layer of silicon adhesive 152 is closely adhered to the sloping surface portion 170*b* around the projecting portion 115*a*.

Then, in a secondary molding process, as shown in FIG. 9(*b*), by a per se known injection molding method, a secondary molded body 180 is formed, so as to cover over the external peripheries of the housing 109 and the nozzle 104, and also the base portion of the sloping surface portion 170*b* of the elongated portion 170*c*. Due to this, the signal line 150 that is adhered to the outer circumferential surfaces of the housing 109 and the nozzle 104, and also the connection portion between the signal line 150 and the projecting portion 115*a* of the external sensor terminal 115, are covered over with this secondary molded body 180.

In other words, as shown in FIG. 9(*b*), the exposed portion 150*a* of the signal line 150 and the projecting portion 115*a* of the external sensor terminal 115 are covered over by the layer of silicon adhesive 152, and the layer of silicon adhesive 152 is covered over by the secondary molded body 180. Since the exposed portion 150*a* of the signal line 150 and the projecting portion 115*a* of the external sensor terminal 115 are covered over by two superimposed layers of material, accordingly their waterproof state is enhanced.

Figure 10:
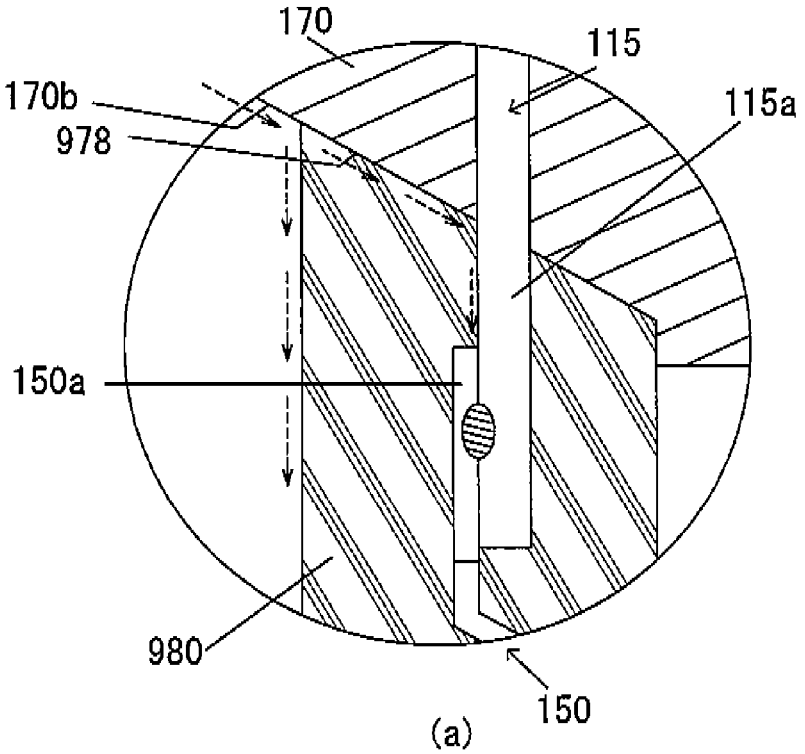
FIG. 10 shows figures schematically showing progression of water through an interface between a molded connector body and the secondary molded body.
Figure 10:
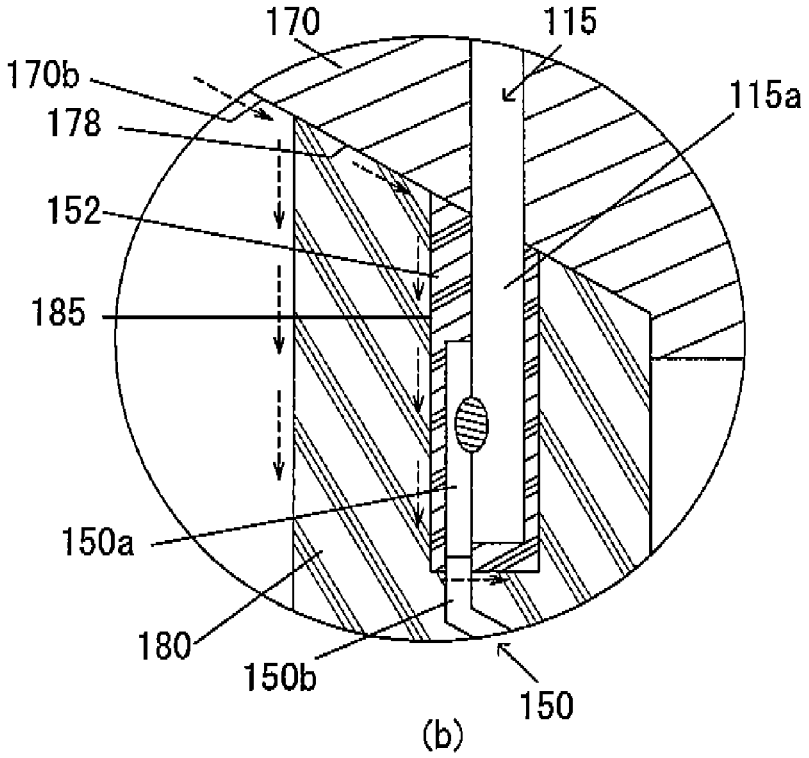

Referring to FIG. 10, the beneficial effects of enhancing the waterproof state of the exposed portion 150*a* and the projecting portion 115*a* by covering them over with the layer of silicon adhesive 152, and by then further covering them over with the secondary molded body 180, will now be explained by comparing this structure to a comparison example. FIG. 10(*a*) is a figure showing a comparison example in which a secondary molded body 980 has been formed without forming any layer of silicon adhesive 152, while FIG. 10(*b*) is a figure showing the first embodiment of the present invention. In FIG. 10(*a*) and FIG. 10(*b*), the progression of water through interfaces 178, 978 between the molded connector body 170 and the secondary molded bodies 180, 980 respectively is schematically shown by the arrow signs.

In some cases, due to heavy rain or the like, it may happen that water penetrates into the engine. As shown in FIG. 10(*a*), water that has adhered to the fuel injection valve 101 flows along the sloping surface portion 170*b* of the molded connector body 170 and arrives at the interface 978 between the molded connector body 170 and the secondary molded body 980. Sometimes it happens that the resin material from which the secondary molded body 980 is made contracts as it hardens in the die, so that a slight clearance is created between the secondary molded body 980 and the molded connector body 170. Due to this, water may progress along the interface 978 between the molded connector body 170 and the secondary molded body 980, and may arrive at the projecting portion 115*a*.

By contrast, with the first embodiment of the present invention, as shown in FIG. 10(*b*), even if water progresses along the interface 178 between the molded connector body 170 and the secondary molded body 180, this progression is hampered by the layer of silicon adhesive 152. It should be understood that sometimes it also may happen that a clearance is present between the layer of silicon adhesive 152 and the secondary molded body 180. However, even if water should penetrate into an interface 185 between the layer of silicon adhesive 152 and the secondary molded body 180, adherence of this water to the exposed portion 150*a* and/or the projecting portion 115*a* is prevented, since the exposed portion 150*a* of the signal line 150 and the projecting portion 115*a* of the external sensor terminal 115 are not positioned upon the path of the water as it progresses along the interface 185.

According to the first embodiment described above, the following beneficial operational effects are obtained.

(1) The fuel injection valve 101 includes: the nozzle 104 that is inserted into the fuel injection valve fitting hole 103 formed in the cylinder head 102; the cylindrical tip seal holder 130 that is attached to the nozzle 104; and the annular tip seal 140 that is fitted to the tip seal holder 130, and that seals between the inner circumferential surface of the fuel injection valve fitting hole 103 and the outer circumferential surface of the tip seal holder 130. In such a structure, by forming the tip seal holder 130 to correspond to the diameter of the fuel injection valve fitting hole 103, it is possible to set the dimension D of the clearance between the fuel injection valve 101 and the fuel injection valve fitting hole 103 on the side toward the pressure sensor 160 than the tip seal 140 to be equal to or smaller than the predetermined value, so that it is possible to prevent destruction of the tip seal 140.

In other words, according to this embodiment, the tip seal holder 130 can be formed according to the diameter of the fuel injection valve fitting hole 103, while it is not necessary to form the nozzle 104 according to the diameter of the fuel injection valve fitting hole 103. Due to this it is possible to anticipate enhancement of the productivity, since it is possible to fit nozzles 104 of the same shape to fuel injection valve fitting holes 103 of a plurality of types whose diameters are different.

Moreover, with a conventional fuel injection valve in which the tip seal is directly fitted on the nozzle, it is necessary to re-design the nozzle when the diameter of the fuel injection valve fitting hole is changed due to change of the specification of the cylinder head 102, and this is undesirable because a great deal of labor and time is required when the specification changes. By contrast, according to this embodiment, even when the diameter of the fuel injection valve fitting hole 103 is changed due to change of the specification of the cylinder head 102, still it is simple and easy to make an appropriate change corresponding to this change to the specification, since it will be sufficient only to change the shape of the tip seal holder 130.

(2) The difference in level 149, to which one end of the tip seal holder 130 engages, is provided on the nozzle 104 of the fuel injection valve 101. Therefore, when fitting the tip seal holder 130 to the nozzle 104, it is possible to position the tip seal holder 130 in its predetermined fitting position in a simple manner, by press fitting the tip seal holder 130 onto the nozzle until one end of the tip seal holder 130 engages with the difference in level 149. Since it is thus possible to perform positional determination of the tip seal holder 130 with respect to the nozzle 104 in a simple manner, accordingly it is possible to anticipate enhancement of the productivity and reduction of the cost.

(3) The insertion groove 132, into which the signal line 150 is inserted, is formed on the inner circumferential surface of the tip seal holder 130, parallel to the central axis X of the tip seal holder 130. Due to this it is possible to establish electrical connection between the pressure sensor 160 that is provided at the end of the nozzle 104 and the external sensor terminal 115, without compromising the sealing performance.

(4) The groove 131, into which the tip seal 140 is set, is formed on the outer circumferential surface of the tip seal holder 130 around its circumferential direction. By setting the tip seal 140 into the groove 131, it is possible to attach the tip seal 140 to the tip seal holder 130 in a simple and easy manner. Moreover, the tip seal 140 is held in its predetermined position by the groove 131, so that it is possible reliably to prevent the combustion gases from leaking out from the cylinder.

(5) The projecting portion 115*a* of the external sensor terminal 115 and the exposed portion 150*a* of the signal line 150 are covered over with the layer of silicon adhesive 152, and the layer of silicon adhesive 152 is covered over with the secondary molded body 180. Due to this, if water should penetrate into the interface 178 between the molded connector body 170, that is the primary molded body, and the secondary molded body 180, then the progression of this water is hampered by the layer of silicon adhesive 152. As a result, the waterproofing of the electrical connection portion between the external sensor terminal 115 and the signal line 150 is enhanced.

(6) Since the external excitation terminals 125 and the external sensor terminal 115 are held by the single molded connector body 170, accordingly it is possible to establish electrical connections between the fuel injection valve 101 and the exterior in a simple and easy manner.

—The Second Embodiment—

Figure 11:
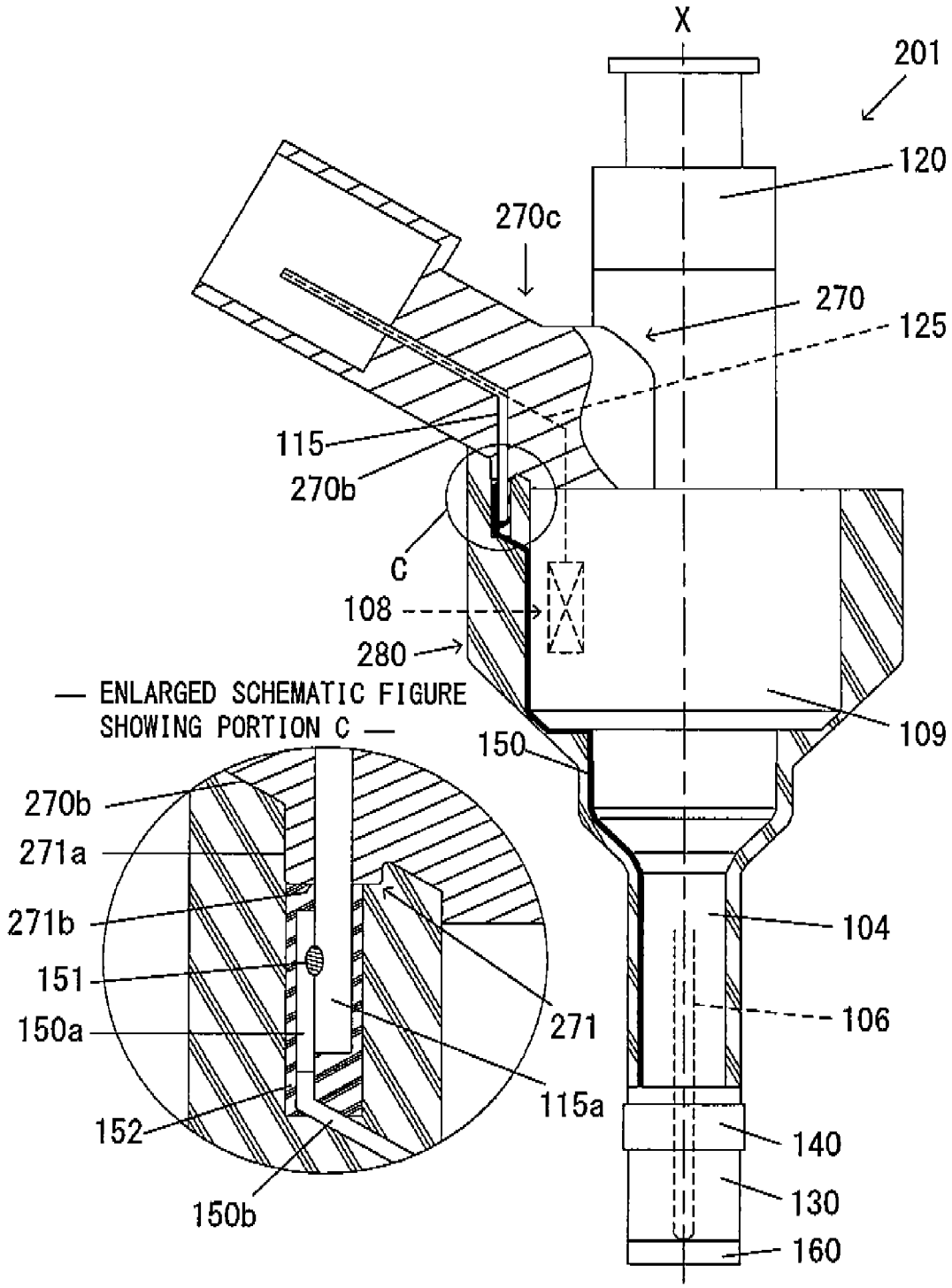
FIG. 11 is a partially cutaway schematic side view showing a fuel injection valve according to a second embodiment of the present invention.
Figure 12:
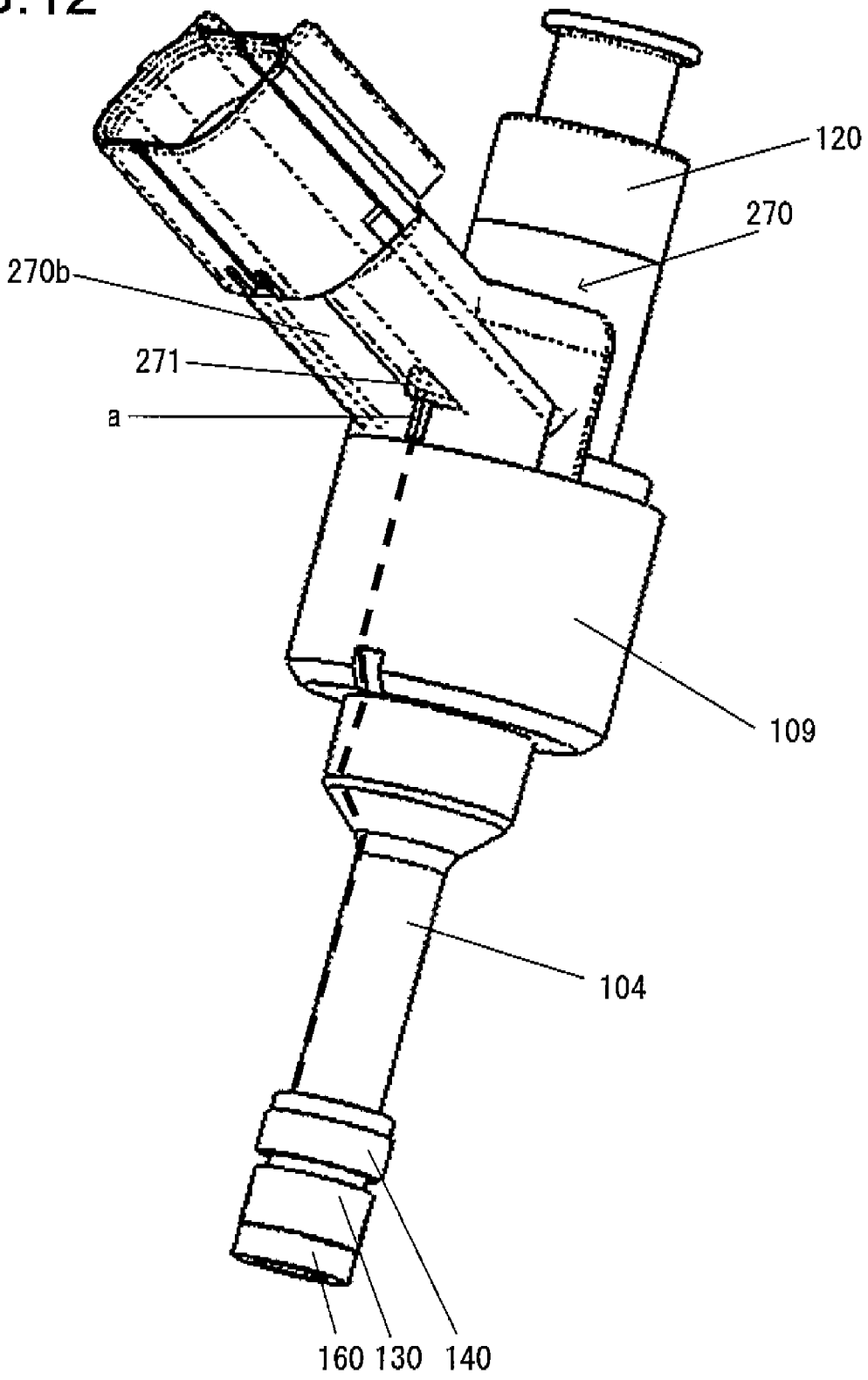
FIG. 12 is an external perspective view showing a state of this fuel injection valve before a secondary molded body thereof is formed.

A fuel injection valve 201 according to a second embodiment of the present invention will now be explained with reference to FIG. 11 and FIG. 12. FIG. 11 is a partially cutaway schematic side view showing this fuel injection valve 201 according to the second embodiment of the present invention, while FIG. 12 is an external perspective view showing the state of this fuel injection valve 201 before a secondary molded body 280 thereof is formed. To portions that are the same or correspond to ones of the first embodiment, the same reference symbols are appended in these figures, and explanation thereof will be omitted. The points of difference from the first embodiment will now be explained in detail.

In the first embodiment, it was arranged for the projecting portion 115*a* to be projected parallel to the central axis X of the fuel injection valve 101 from the sloping surface portion 170*b*, that was the side of the elongated portion 170*c* of the molded connector body 170 facing toward the pressure sensor 160 (refer to FIG. 2). By contrast, in this second embodiment, as shown in FIG. 11 and FIG. 12, a convex portion 271 is provided so as to project parallel to the central axis X of the fuel injection valve 201 from a sloping surface portion 270*b*, that is the side of an elongated portion 270*c* of a molded connector body 270 facing toward the pressure sensor 160.

This convex portion 271 has a planar side portion 271*a* that is parallel to the central axis X, and a top surface portion 271*b* that is orthogonal to the central axis X. In this second embodiment, the projecting portion 115*a* of the external sensor terminal 115 projects from the top surface portion 271*b* of the convex portion 271 towards the pressure sensor 160.

According to the second embodiment having this structure, similar beneficial operational effects are obtained as in the case of the first embodiment described above. Moreover, according to this second embodiment, it is possible to make the path of progression of water longer, from where it penetrates into the interface between the secondary molded body 280 and the molded connector body 270, that is the primary molded body, until it arrives at the layer of silicon adhesive 152. Due to this, even if water penetrates into the interface between the secondary molded body 280 and the molded connector body 270, it is possible to make this water effectively evaporate before it flows as far as reaching the layer of silicon adhesive 152. Therefore, according to this second embodiment, the waterproofing is enhanced as compared to the first embodiment.

The following variations are also considered to fall within the scope of the present invention, and, moreover, it would be possible to combine one or a plurality of these variant embodiments with either of the embodiments described above.

(1) While, in the embodiments described above, by way of example, the pressure sensor 160 was explained as being a unit for state detection attached at the end of the fuel injection valve 101, the present invention is not to be considered as being limited by this feature. For example, the present invention could also be applied to a case in which a thermocouple that measures the temperature within the cylinder is attached at the end of the fuel injection valve 101 as a unit for state detection.

(2) While, in the second embodiment, it was arranged to provide the convex portion 271, thus making the progression path of water longer from where it penetrates into the interface between the molded connector body 270 and the secondary molded body 280 until it arrives at the layer of silicon adhesive 152, the shape of the convex portion 271 is not to be considered as being limited to the one described above. It would also be possible to arrange to provide a portion having any appropriate concave and/or convex shape, so as to make the above water progression path yet longer.

(3) While, in the embodiments described above, it was arranged to form the insertion groove 132 on the inner circumferential surface of the tip seal holder 130, the present invention is not to be considered as being limited by this feature. It would also be acceptable to arrange not to provide any such insertion groove 132 on the inner circumferential surface of the tip seal holder 130, but to form an insertion groove on the outer circumferential surface of the nozzle 104 parallel to the central axis X, with the signal line 150 that connects between the pressure sensor 160 and the external sensor terminal 115 being inserted into this insertion groove provided in the nozzle 104.

(4) While, in the embodiments described above, the exposed portion 150*a* of the signal line 150 and the projecting portion 115*a* of the external sensor terminal 115 were electrically connected together with the solder 151, the present invention is not to be considered as being limited by this structure. For example, it would also be acceptable to connect the exposed portion 150*a* of the signal line 150 and the projecting portion 115*a* of the external sensor terminal 115 together electrically by using a low temperature sintering joining material that includes silver sheet and minute metallic grains, or the like.

While, as described above, various embodiments and variant embodiments have been explained, the present invention is not to be considered as being limited by the details thereof. Other implementations that are considered to be embraced within the range of the technical concept of the present invention are also included within the scope of the present invention.

The content of the disclosure of the following application, upon which priority is claimed, is hereby installed herein by reference:

Japanese Patent Application No. 2012-130923 (filed on 8 Jun. 2012).

EXPLANATION OF REFERENCE NUMERALS

100: fuel injection device, 101: fuel injection valve, 102: cylinder head, 103: fuel injection valve fitting hole, 104: nozzle, 106: movable valve body, 108: electromagnetic coil, 109: housing, 115: external sensor terminal, 115*a*: projecting portion, 115*b*: sensor connection terminal, 120: core, 125: external excitation terminals, 125*b*: excitation connection terminals, 130: tip seal holder, 131: groove, 132: insertion groove, 138: clearance, 140: tip seal, 149: difference in level, 150: signal line, 150*a*: exposed portion, 150*b*: covering material, 151: solder, 152: layer of silicon adhesive, 160: pressure sensor, 170: molded connector body, 170*a*: connector portion, 170*b*: sloping surface portion, 170*c*: elongated portion, 178: interface, 180: secondary molded body, 185: interface, 190: ECU, 191: injection amount calculation unit, 192: injection time calculation unit, 195: drive circuit, 196, 197: wiring, 198: signal processing unit, 201: fuel injection valve, 270: molded connector body, 2706*b*: sloping surface portion, 270*c*: elongated portion, 271: convex portion, 271*a* planar side portion, 271*b*: top surface portion, 280: secondary molded body, 978: interface, 980: secondary molded body.

The invention claimed is:

1. A fuel injection valve that injects fuel directly into a cylinder of an internal combustion engine, comprising:

a nozzle inserted into a fuel injection valve fitting hole formed in the cylinder;

a cylindrical tip seal holder attached to the nozzle; and an annular seal member that is fitted to the cylindrical tip seal holder and that seals between an inner circumferential surface of the fuel injection valve fitting hole and an outer circumferential surface of the cylindrical tip seal holder, wherein an insertion groove for a signal line is formed on an inner circumferential surface of the cylindrical tip seal holder along a central axis of the cylindrical tip seal holder, and the signal line passes through an inner diameter side of the annular seal member.

2. The fuel injection valve according to claim 1, wherein:

a stepped part to which one end of the cylindrical tip seal holder engages is provided on the nozzle, the nozzle forms a large outer diameter part, a small outer diameter part, and the stepped part, which is formed between the large outer diameter part and the small outer diameter part, the cylindrical tip seal holder is inserted around the small outer diameter part, and one end of the cylindrical tip seal holder engages with the stepped part.

3. The fuel injection valve according to claim 1, wherein:

a groove into which the annular seal member is set is formed on the outer circumferential surface of the cylindrical tip seal holder, around its circumferential direction.

4. The fuel injection valve according to claim 2, wherein:

a groove into which the annular seal member is set is formed on the outer circumferential surface of the cylindrical tip seal holder, around its circumferential direction.

5. The fuel injection valve according to claim 1, wherein:

the cylindrical tip seal holder is laser welded in a predetermined position.

6. The fuel injection valve according to claim 1, further comprising:

a pressure sensor that is provided at a cylinder-side end of the fuel injection valve.

7. The fuel injection valve according to claim 6, wherein one end of the groove is closed with the pressure sensor.

* * * * *